US007055939B2

(12) United States Patent
Norkitis et al.

(10) Patent No.: US 7,055,939 B2
(45) Date of Patent: Jun. 6, 2006

(54) DROP GENERATOR

(75) Inventors: Michael E. Norkitis, Newberg, OR (US); Douglas D. Darling, Portland, OR (US)

(73) Assignee: Xerox Corporation, Stamford, CT (US)

( * ) Notice: Subject to any disclaimer, the term of this patent is extended or adjusted under 35 U.S.C. 154(b) by 279 days.

(21) Appl. No.: 10/719,044

(22) Filed: Nov. 20, 2003

(65) Prior Publication Data

US 2005/0110834 A1 May 26, 2005

(51) Int. Cl.
*B41J 2/45* (2006.01)

(52) U.S. Cl. ..... 347/68; 347/69

(58) Field of Classification Search ..... 347/44, 347/65, 68, 87, 72, 86, 69
See application file for complete search history.

(56) References Cited

U.S. PATENT DOCUMENTS 4,334,234 A * 6/1982 Shirato et al. ..... 347/65
5,736,993 A * 4/1998 Regimbal et al. ..... 347/11
6,217,141 B1 4/2001 Nakamura et al. ..... 347/10
6,217,159 B1 4/2001 Morikoshi et al. ..... 347/71
6,305,773 B1 10/2001 Burr et al. ..... 347/11
6,312,080 B1 11/2001 De Roos et al. ..... 347/14
6,598,950 B1 7/2003 Hosono et al. ..... 347/11
2001/0028378 A1 10/2001 Lee et al.

FOREIGN PATENT DOCUMENTS

EP 0792744 A2 9/1997
EP 1321294 A2 6/2003
EP 1321294 A2 * 6/2003
JP 55117666 9/1980
WO WO 02/32674 A1 4/2002

OTHER PUBLICATIONS

Examiner M. Bardet, European Patent Office, European Search Report for Application No. EP 04027289, Feb. 24, 2005, 3 pages, Search performed in The Hague.

* cited by examiner

*Primary Examiner*—Stephen Meier
*Assistant Examiner*—Rachel Dicht
(74) *Attorney, Agent, or Firm*—Manuel Quiogue

(57) ABSTRACT

A drop generator that includes a pressure chamber and an outlet channel that includes a circular outlet channel section and a non-circular outlet channel section.

40 Claims, 2 Drawing Sheets

DROP GENERATOR

BACKGROUND OF THE DISCLOSURE

The subject disclosure is generally directed to drop generators that can be useful for applications such as ink jet printing.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet drop generator structure employs an electromechanical transducer to displace ink from an ink chamber into a drop forming outlet passage, and it can be difficult to control drop velocity and/or drop mass.

DETAILED DESCRIPTION OF THE DISCLOSURE

Figure 1:
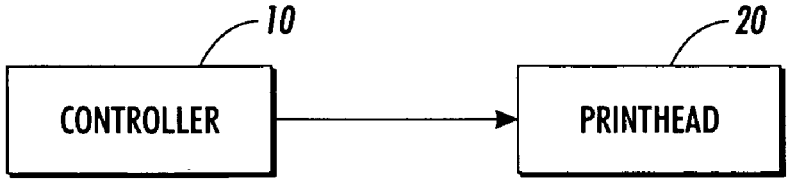
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
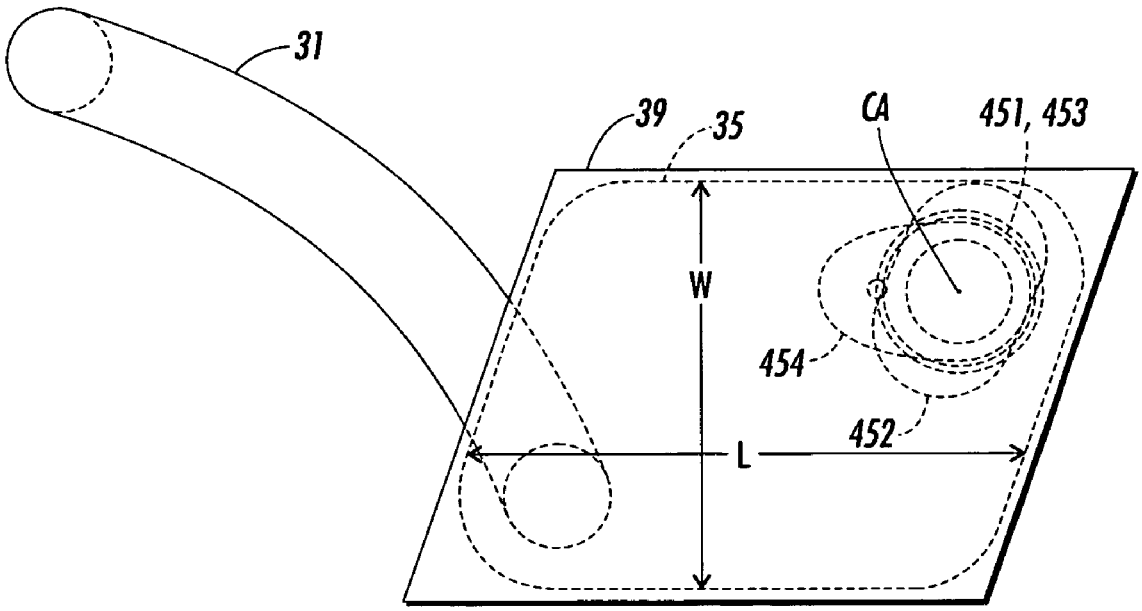
FIG. 2 is a schematic plan view of an embodiment of a drop generator that can be employed in the drop emitting apparatus of FIG. 1.
Figure 3:
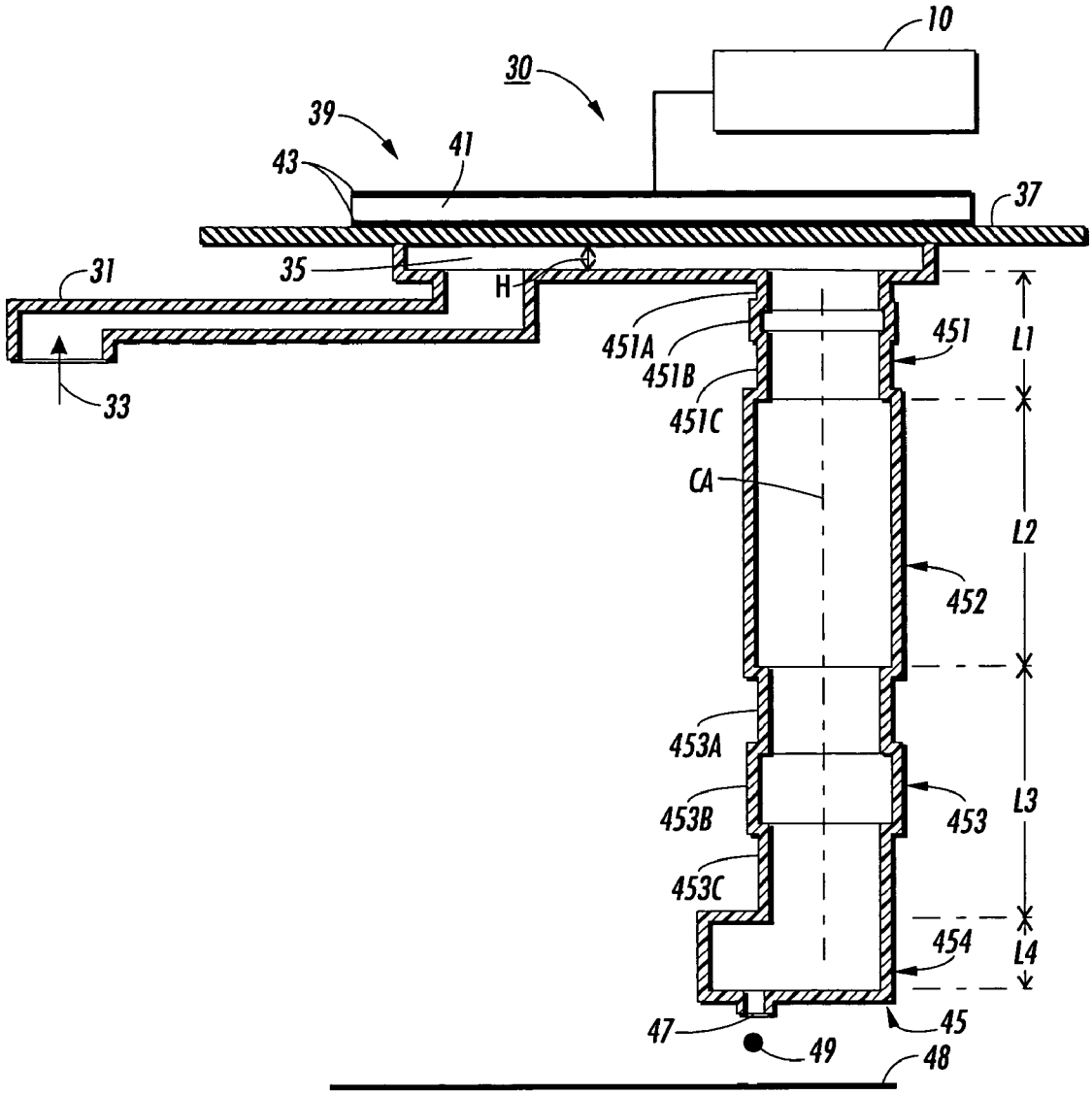
FIG. 3 is a schematic elevational view of the drop generator of FIG. 2.

FIGS. 2 and 3 are a schematic plan view and a schematic elevational view of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47 at an end thereof.

The ink 33 can be melted or phase changed solid ink, and the electromechanical transducer 39 can be a piezoelectric transducer that is operated in a bending mode, for example.

The outlet channel 45 generally includes a plurality of sections or segments of differently shaped cross-sections. For example, the outlet channel 45 can include a first circular outlet channel section 451 having a circular cross-section, a first non-circular outlet channel section 452 having a non-circular cross-section, a second circular outlet channel section 453 having a circular cross-section, and a second non-circular outlet channel section 454 having a non-circular cross-section. By way of illustrative example, the first circular outlet channel section 451 is connected to the ink pressure chamber 35, the first non-circular outlet channel section 452 is connected to the first circular outlet channel section 451, the second circular outlet channel section 453 is connected to the first non-circular outlet channel section 452, and the second non-circular outlet channel section 454 is connected to the second circular outlet channel section 453. As another example, the outlet channel 45 can include a non-circular outlet channel section connected to the ink chamber 35, a circular outlet channel section connected to the non-circular outlet channel section and a non-circular outlet channel section connected to the circular outlet channel section.

The first circular outlet channel section 451 can have substantially co-axial circular sub-sections 451A, 451B, 451C of different cross-sectional areas, for example. Similarly, the second circular outlet channel section 453 can have substantially co-axial circular sub-sections 453A, 453B, 453C of different cross-sectional areas.

The first non-circular outlet channel section 452 can have an oval cross-section, while the second non-circular outlet channel section 454 can have an egg-shaped cross-section. The nozzle or aperture can be located at a smaller end of the egg-shaped cross section, for example at a center of the radius of the end of the cross-section having the smaller radius.

The first circular outlet channel section 451, the first non-circular outlet channel section 452, and the second circular outlet channel section 453 can be centered on an outlet channel axis CA. For the example of a second non-circular outlet channel section 454 having an egg shaped cross-section, the center of the radius of the larger end of the egg-shaped cross-section can be located on the outlet channel axis CA and the nozzle or aperture would offset from the outlet channel axis CA.

The first circular outlet channel section 451 can have a length L1 that is less than about $^{20}/_{1000}$ inches, for example in the range of about $^{11}/_{1000}$ inches to about $^{13}/_{1000}$ inches. The first circular outlet channel section 451 can have an average diameter in the range of about $^{10}/_{1000}$ inches to about $^{20}/_{1000}$ inches, for example. The first circular outlet channel section 451 can also have an average diameter in the range of about $^{11}/_{1000}$ inches to about $^{13}/_{1000}$ inches. Average diameter refers to the average of the diameters of the sub-sections of the first circular outlet channel section 451.

The second circular outlet channel section 453 can have a length L3 that is less than about $^{40}/_{1000}$ inches, for example in the range of about $^{24}/_{1000}$ inches to about $^{26}/_{1000}$ inches. The second circular outlet channel section 453 can have an average diameter in the range of about $^{8}/_{1000}$ inches to about 15/1000 inches. As another example, the second circular outlet channel section 453 can have an average diameter in the range of about 12/1000 inches to about 14/1000 inches. Average diameter refers to the average of the diameters of the sub-sections of the second circular outlet channel section 453.

The first non-circular channel section 452 can have a length L2 that is less than about 40/1000 inches, for example in the range of about 27/1000 inches to about 29/1000 inches. The first non-circular outlet channel section can have an effective diameter in the range of about 10/1000 inches to about 20/1000 inches, for example. As another example, the first non-circular outlet channel section 452 can have an effective diameter in the range of about 15/1000 inches to about 17/1000 inches. Effective diameter refers to a diameter of a circle having the same area as the cross-sectional area of the first non-circular outlet channel section 452.

The second non-circular outlet channel section 454 can have a length L4 in the range of about 4/1000 inches to about 10/1000 inches. As another example, the second non-circular outlet channel section 454 can have a length L4 in the range of about 7/1000 inches to about 9/1000 inches. The second non-circular outlet channel section 454 can have an effective diameter in the range of about 8/1000 inches to about 16/1000 inches. By way of further example, the second non-circular outlet channel section 454 can have an effective diameter in the range of about 13/1000 inches to about 16/1000 inches. Effective diameter refers to a diameter of a circle having the same area as the cross-sectional area of the second non-circular outlet channel section 454.

The outlet channel 45 can have an overall length in the range of about 59/1000 inches to about 79/1000 inches. As another example, the outlet channel 45 can have an overall length in the range of about 69/1000 inches to about 77/1000 inches.

The nozzle or aperture 47 can have a length of about 1.5/1000 inches, and a diameter of about 41.5 micrometers.

The ink chamber 35 can be generally parallelogram shaped or generally rectangular, for example. The corners of the ink chamber 35 can be rounded. By way of illustrative example, the ink chamber 35 can have a height or thickness H in the range of about 3/1000 inches to about 5/1000 inches, a width W in the range of about 29/1000 inches to about 37/1000 inches, and a length L in the range of about 38/1000 inches to about 47/1000 inches. By way of further example, the ink chamber 35 can have a height or thickness H in the range of about 4/1000 inches, a width W in the range of about 33/1000 inches to about 35/1000 inches, a length L in the range of about 42/1000 inches to about 44/1000 inches. The width W and the length L refer to those dimensions of a parallelogram or rectangle that define the area of a parallelogram or rectangle.

The inlet 31 and the outlet channel 45 can be connected to the ink chamber 35 at opposing corner regions of a generally trapezoidal or generally rectangular ink chamber 35, for example. By way of illustrative example, the inlet 31 can have a length in the range of about 49/1000 inches to about 62/1000 inches, a width in the range of about 6/1000 inches to about 10/1000 inches, and a height in the range of about 2/1000 inches to about 5/1000 inches.

By way of illustrative example, the drop generator can operate at a drop emitting frequency in the range of about 23 KHz to about 30 KHz. The drop generator can emit drops having a drop mass in the range of about 20 nanograms to about 30 nanograms, for example. As another example, the drop generator can emit drops having a mass in the range of about 23 nanograms to about 27 nanograms.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop generator comprising:

a pressure chamber;

an inlet channel connected to the pressure chamber;

an outlet channel connected to the pressure chamber;

the outlet channel including a first circular outlet channel section connected to the pressure chamber, a first non-circular outlet channel section connected to the first circular outlet channel section, a second circular outlet channel section connected to the first non-circular outlet channel section, and a second non-circular outlet channel section connected to the second circular outlet section; and a drop emitting nozzle disposed at an end of the second non-circular outlet channel.

2. The drop generator of claim 1 further including a piezoelectric element.

3. The drop generator of claim 1 wherein the inlet channel receives melted solid ink.

4. The drop generator of claim 1 wherein at least one of the first circular section and the second circular section includes a first circular sub-section and a second circular sub-section.

5. The drop generator of claim 1 wherein the first non-circular section has an oval cross-section.

6. The drop generator of claim 1 wherein the non-circular section has a generally egg-shaped cross-section.

7. The drop generator of claim 1 wherein the non-circular section has a generally egg-shaped cross-section, and wherein the nozzle is disposed at a smaller end of the egg-shaped cross-section.

8. The drop generator of claim 1 wherein the nozzle is disposed at an end of the non-circular section.

9. The drop generator of claim 1 wherein the ink pressure chamber has a cross-section that is generally parallelogram shaped.

10. The drop generator of claim 1 wherein the nozzle emits drops having a mass in the range of about 20 nanograms to about 30 nanograms.

11. The drop generator of claim 1 wherein the pressure chamber is operated at a frequency of about 23 KHz to about 30 KHz.

12. The drop generator of claim 1 wherein the outlet channel has a length in the range of about 59/1000 inches to about 79/1000 inches.

13. The drop generator of claim 1 wherein the outlet channel has a length in the range of about 69/1000 inches to about 77/1000 inches.

14. The drop generator of claim 1 wherein the first circular outlet channel section has a length that is less than about 20/1000 inches.

15. The drop generator of claim 1 wherein the first circular outlet channel section has a length in range of about 11/1000 inches to about 13/1000 inches.

16. The drop generator of claim 1 wherein the second circular outlet channel section has a length that is less than about 40/1000 inches.

17. The drop generator of claim 1 wherein the second circular outlet channel section has a length in the range of about 24/1000 inches to about 26/1000 inches.

18. The drop generator of claim 1 wherein the first circular outlet channel section has an average diameter in the range of about 10/1000 inches to about 20/1000 inches.

19. The drop generator of claim 1 wherein the first circular outlet channel section has an average diameter in the range of about 11/1000 inches to about 13/1000 inches.

20. The drop generator of claim 1 wherein the second circular outlet channel section has an average diameter in the range of about 8/1000 inches to about 15/1000 inches.

21. The drop generator of claim 1 wherein the second circular outlet channel section has an average diameter in the range of about 12/1000 inches to about 1/1000 inches.

22. The drop generator of claim 1 wherein the first non-circular outlet channel section has a length that is less than about 40/1000 inches.

23. The drop generator of claim 1 wherein the first non-circular outlet channel section has a length in the range of about 27/1000 inches to about 29/1000 inches.

24. The drop generator of claim 1 wherein the second non-circular outlet channel section has a length in the range of about 4/1000 inches to about 10/1000 inches.

25. The drop generator of claim 1 wherein the second non-circular outlet channel section has a length in the range of about 7/1000 inches to about 9/1000 inches.

26. The drop generator of claim 1 wherein the first non-circular outlet channel section has an effective diameter of about 10/1000 inches to about 20/1000 inches.

27. The drop generator of claim 1 wherein the first non-circular outlet channel section has an effective diameter of about 15/1000 inches to about 17/1000 inches.

28. The drop generator of claim 1 wherein the second non-circular outlet channel section has an effective diameter of about 8/1000 inches to about 16/1000 inches.

29. The drop generator of claim 1 wherein the second non-circular outlet channel section has an effective diameter of about 13/1000 inches to about 16/1000 inches.

30. A drop generator comprising:

a pressure chamber;

an inlet channel connected to the pressure chamber;

an outlet channel connected to the pressure chamber, the outlet channel having an outlet channel axis;

the outlet channel including a first circular outlet channel section connected to the pressure chamber, a first non-circular outlet channel section connected to the first circular outlet channel section, a second circular outlet channel section connected to the first non-circular outlet channel section, and a second non-circular outlet channel section connected to the second circular outlet section;

wherein the first circular outlet channel section, the first non-circular outlet channel section, and the second circular outlet channel section are substantially centered on the outlet channel axis; and a nozzle disposed at an end of the second non-circular outlet channel section and offset from the outlet channel axis.

31. The drop generator of claim 30 wherein the second non-circular outlet channel section has a generally egg-shaped cross-section.

32. The drop generator of claim 30 wherein the first circular outlet channel section includes a plurality of circular sub-sections.

33. The drop generator of claim 30 wherein the second circular outlet channel section includes a plurality of circular sub-sections.

34. The drop generator of claim 30 wherein the ink pressure chamber has a cross-section that is generally parallelogram shaped.

35. The drop generator of claim 30 wherein the nozzle emits drops having a mass in the range of about 20 nanograms to about 30 nanograms.

36. The drop generator of claim 30 wherein the pressure chamber is operated at a frequency of about 23 KHz to about 30 KHz.

37. A drop generator comprising:

a pressure chamber;

an inlet channel connected to the pressure chamber;

an outlet channel connected to the pressure chamber, the outlet channel having an outlet channel axis;

a drop emitting nozzle disposed at an end of the outlet channel; and the outlet channel including a circular outlet channel section and a non-circular outlet channel section having an oval cross-section.

38. A drop generator comprising:

a pressure chamber;

an inlet channel connected to the pressure chamber;

an outlet channel connected to the pressure chamber, the outlet channel having an outlet channel axis;

a drop emitting nozzle disposed at an end of the outlet channel; and the outlet channel including a circular outlet channel section and a non-circular outlet channel section having a generally egg-shaped cross-section.

39. The drop generator of claim 38 wherein the nozzle is disposed at a smaller end of the egg-shaped cross-section.

40. A drop generator comprising:

a pressure chamber;

an inlet channel connected to the pressure chamber;

an outlet channel connected to the pressure chamber, the outlet channel having an outlet channel axis;

a drop emitting nozzle disposed at an end of the outlet channel, wherein the nozzle emits drops having a mass in the range of about 20 nanograms to about 30 nanograms; and the outlet channel including a circular outlet channel section and a non-circular outlet channel section.

* * * * *